US008169325B2

(12) United States Patent
Verdiramo

(10) Patent No.: US 8,169,325 B2
(45) **Date of Patent: *May 1, 2012**

(54) PORTABLE HAND WASH MONITORING SYSTEM AND METHOD

(76) Inventor: Vincent L. Verdiramo, Martinsville, NJ (US)

( * ) Notice: Subject to any disclaimer, the term of this patent is extended or adjusted under 35 U.S.C. 154(b) by 232 days.

This patent is subject to a terminal disclaimer.

(21) Appl. No.: 12/585,126

(22) Filed: Sep. 4, 2009

(65) Prior Publication Data

US 2010/0207767 A1 Aug. 19, 2010

Related U.S. Application Data

(63) Continuation-in-part of application No. 12/379,130, filed on Feb. 13, 2009.

(51) Int. Cl.
*G08B 23/00* (2006.01)

(52) U.S. Cl. ..... 340/573.1; 340/539.23; 340/286.07; 340/286.09; 222/52; 4/619

(58) Field of Classification Search ..... 340/573.1, 340/286.07, 286.09; 222/52, 39, 638, 639, 222/651

See application file for complete search history.

(56) References Cited

U.S. PATENT DOCUMENTS 4,805,673 A * 2/1989 Wohrle et al. ..... 141/10
5,863,497 A * 1/1999 Dirksing ..... 422/28
5,924,148 A * 7/1999 Flowers, Sr. ..... 4/619
6,161,227 A * 12/2000 Bargenquast ..... 4/622
6,206,238 B1 * 3/2001 Ophardt ..... 222/1
6,236,317 B1 * 5/2001 Cohen et al. ..... 340/573.1
6,375,038 B1 * 4/2002 Daansen et al. ..... 222/52
7,443,305 B2 * 10/2008 Verdiramo ..... 340/573.5
7,451,894 B2 * 11/2008 Ophardt ..... 222/52
7,665,811 B2 * 2/2010 Johanning ..... 312/209
7,765,916 B2 * 8/2010 Ophardt et al. ..... 92/140
2002/0175182 A1 * 11/2002 Matthews ..... 222/52
2004/0090333 A1 * 5/2004 Wildman et al. ..... 340/573.1
2008/0103636 A1 * 5/2008 Glenn et al. ..... 700/302
2008/0131332 A1 * 6/2008 Nguyen et al. ..... 422/119
2010/0207766 A1 * 8/2010 Verdiramo ..... 340/573.1

* cited by examiner

*Primary Examiner* — George Bugg
*Assistant Examiner* — Anne Lai
(74) *Attorney, Agent, or Firm* — Thomas J. Germinario

(57) ABSTRACT

An identification badge worn by an individual is sensed when that individual enters a lavatory area. The individual is also provided with an indicator device which is worn on or about the hands. Inside or in proximity to the lavatory, there is also provided a hand cleaning area, within which is a portable monitoring dispenser, which includes a pair of indicator readers that detect the presence of the indicator device and cause soap to be dispensed on the individual's hands, then provides an appropriate indication to a computer system. Should the badge sensor sense the individual's departure from the lavatory area without an appropriate indication being generated by the indicator readers, a warning signal is generated, which is sent to the computer system and to an appropriate officer, who can then address the individual.

3 Claims, 6 Drawing Sheets

PORTABLE HAND WASH MONITORING SYSTEM AND METHOD

CROSS-REFERENCE TO RELATED APPLICATIONS

The present application is a continuation-in-part of U.S. application Ser. No. 12/379,130, filed Feb. 13, 2009.

FIELD OF THE INVENTION

The present invention relates generally to security systems and, more particularly, concerns a portable system and method for monitoring whether individuals using a lavatory or similar facility wash their hands.

BACKGROUND OF THE INVENTION

The present invention is an improvement of the "Hand Wash Monitoring System and Method" as disclosed in U.S. Pat. No. 7,443,305, issued Oct. 28, 2008, to Vincent L. Verdiramo, which patent is hereafter referred to as the "2008 Hand Wash Patent", the contents of which are incorporated herein by reference. The present invention is an alternate embodiment of the "Improved Hand Wash Monitoring System and Method" disclosed in U.S. patent application Ser. No. 12/379,130, filed Feb. 13, 2009, by Vincent L. Verdiramo (of which this application is a continuation-in-part), which application is hereafter referred to as the "Parent Application", the contents of which are incorporated herein by reference.

As described in the 2008 Hand Wash Patent, when a monitored individual, such a restaurant employee, enters or exits a lavatory, an identification device worn by the monitored individual is sensed by an identity sensor located near the lavatory door. The monitored individual also wears an indicator device on or about his/her hands. Inside the lavatory, there is a hand cleaning station that has soap dispensers positioned above a dispenser opening, within which is a pair of indicator readers that are activated by detecting the indicator device when the monitored individual inserts his/her hands into the dispenser opening. Should the identity sensor sense the individual's departure from the lavatory without receiving confirmation of hand washing activity from the indicator readers, a warning signal is generated, which is sent to the computer system and to an appropriate officer, who can then reprimand the individual.

In the preferred embodiment described in the 2008 Hand Wash Patent, the hand cleaning station also has a sensor light emitter that projects one or more light beams across the dispenser opening to a sensor light reader, such that when the hands of the monitored individual are inserted into the dispenser opening to access the soap dispenser, the light beams are broken and a corresponding signal is sent to a dispenser controller, which dispenser controller responds to the signal by activating the soap dispensers to deposit a hand wash solution on the hands of the monitored individual.

The preferred embodiment described in the 2008 Hand Wash Patent has the disadvantage of having redundant hand detection apparatus in the hand wash station, insofar as it requires both a pair of indicator readers and a sensor light emitter-receiver pair, with the former serving to detect the indicator device on the monitored individual's hands and the latter serving to dispense soap onto the individual's hands. This redundancy adds both to the expense of the hand cleaning station and the potential for malfunction.

In the Parent Application, this redundancy is eliminated by utilizing the indicator readers alone to perform both functions, i.e. both detecting the presence of the individual's hands within the dispenser opening and activating the soap dispenser. The disclosure of the Parent Application also further refines the hand cleaning stations design by providing a mechanism for computerized control of the amount of hand wash solution dispensed by the soap dispensers.

The present invention is a portable version of the improved hand wash monitoring system disclosed in the Parent Application. This invention can be used in remote locations and/or locations where indoor plumbing is not available. The portable hand wash monitoring system meets the need to monitor hand hygiene relating to handling of food products during such operations as harvesting, butchering, packaging and shipping. This invention is also useful to monitor hand hygiene of outdoor food vendors and handlers. It can also be used to monitor hand hygiene of care-givers in emergency medical response situations at the scene of an incident. Such activities typically occur at locations where installation of a permanent monitoring system is not feasible, or where conventional indoors lavatories are not available.

SUMMARY OF THE INVENTION

The present invention is a portable system and method for monitoring cleaning of the hands of one or more monitored individuals. The system comprises a lavatory area, one or more identity sensors, one or more cleaning areas, one or more portable monitoring dispensers, one or more identification devices, one or more indicator devices, one or more system control devices, a remote data retrieval means, and one or more alarms.

The lavatory area may be indoors or outdoors, and it may consist of a portable lavatory facility, such as "Port-a-John". The lavatory area may be totally or partially enclosed, and it may be accessed by one or more doors and/or openings. One or more identity sensors are located within or in close proximity to the lavatory area, with each identity sensor being proximate to one of the doors and/or openings.

One or more cleaning areas are located within or in proximity to the lavatory area. The cleaning areas may be indoors or outdoors, and they may be unenclosed, totally enclosed or partially enclosed. Each cleaning area comprises one or more sources of fresh running water, such as a hose or a faucet, and one or more wastewater receptacles, such as a basin or a sink.

Within each of the cleaning areas is/are located one or more portable monitoring dispensers (PMDs), with each of the PMDs being in close proximity to one of the sources of running water and one of the wastewater receptacles. Each PMD comprises one or more pairs or indicator readers, one or more dispenser openings, a system control device, one or more soap dispensers, one or more dispenser controllers, one or more soap storage tanks, a mobile power source, and one or more attachment means.

One or more pairs of indicator readers are located within each of the PMDs, and each pair of indicator readers comprises an indicator reader A and an indicator reader B. Indicator reader A is located proximate to the soap dispenser, and indicator reader B is located apart from indicator reader A, below or to the side, such that the space between indicator reader A and indicator reader B constitutes a dispenser opening through which the hands of the monitored individual are inserted in order to access the soap dispenser.

An identification device, such as a badge, is worn by each monitored individual, such that when the monitored individual enters or leaves the lavatory area through one of the doors or openings, the identity sensor that is proximate to the door/opening senses the identification device and transmits the identity of the monitored individual who has passed through the door to the system control device. The system control device may be an internal component of the PMD, or it may be an external unit, such as a laptop computer. The system control device communicates with the remote data retrieval means either wirelessly or through USB upload. In the preferred embodiment, the system control device is a CPU controller box located within each PMD that communicates wirelessly with a remote computer.

Each monitored individual wears on or about one or both hands one or more indicator devices, such a bracelet or wristband. When the hands of the monitored individual are placed beneath the soap dispenser in the dispenser opening between indicator reader A and indicator reader B, both indicator readers A and B sense the presence of the indicator device(s) and transmit an indication signal to the system control device indicating that the monitored individual has washed his/her hands. Upon receiving the indication signal, the system control device sends an activation signal to the dispenser controller, which dispenser controller responds to the activation signal by activating the soap dispenser to deposit a hand wash solution on the hands of the monitored individual.

Optionally, the indicator device can also function as the identification device, so that the monitored individual will wear only one combined identification-indicator device that can be monitored by both the identity sensor and the indicator readers. Also optionally, the identification device, the indicator device and/or the combined identification-indicator device may have internal data-storage capability, such that it can store data regarding the time and location at which the individual uses a PMD and transmit that data to the remote data retrieval means wirelessly or by USB upload.

In the preferred embodiment, the dispenser controller comprises an electric motor and a helical screw conveyor. The activation signal causes the electric motor to be activated for a designated time interval. The motor has a shaft which rotates when the motor is activated. The shaft is coupled to the helical screw conveyor by a gearing means, consisting to two gears, which can be spur, helical, worm, or bevel gears. Thus, when the motor is activated by the activation signal, the helical screw conveyor rotates for the designated time interval, thereby drawing a set quantity of hand wash solution out of the storage tank, which is fluidly connected to the dispenser controller. The set quantity of hand wash solution dispensed is determined by the system control device based on the rotational speed of the motor, the gear ratio, the designated time interval, and the depth and pitch of the thread of the helical screw conveyor.

An alarm generates a warning signal whenever the system control device has received transmissions from the identity sensor(s) indicating that the monitored individual has entered and exited from the enclosed area without the system control device also having received a signal from both indicator reader A and indicator reader B that the monitored individual has washed his/her hands.

Electrical power is provided to system control device, to the electric motor of the dispenser controller, and to the alarm by a mobile power source, which may be either an internal component of the PMD or a stand-alone unit. In the preferred embodiment, the mobile power source comprises one or more long-life, high-capacity rechargeable batteries, or one or more solar energy cells.

The PMD has one or more attachment means, by which it is mountable to any available support, such as a pole, a fence, an outdoor structure, or a portable lavatory.

BRIEF DESCRIPTION OF THE DRAWINGS

The foregoing brief description, as well as other features and advantages of the present invention will be understood more completely from the following detailed description of a presently preferred, but nonetheless illustrative, embodiment of the invention, with reference being had to the accompanying drawings in which.

DETAILED DESCRIPTION OF THE PREFERRED EMBODIMENT

Figure 1:
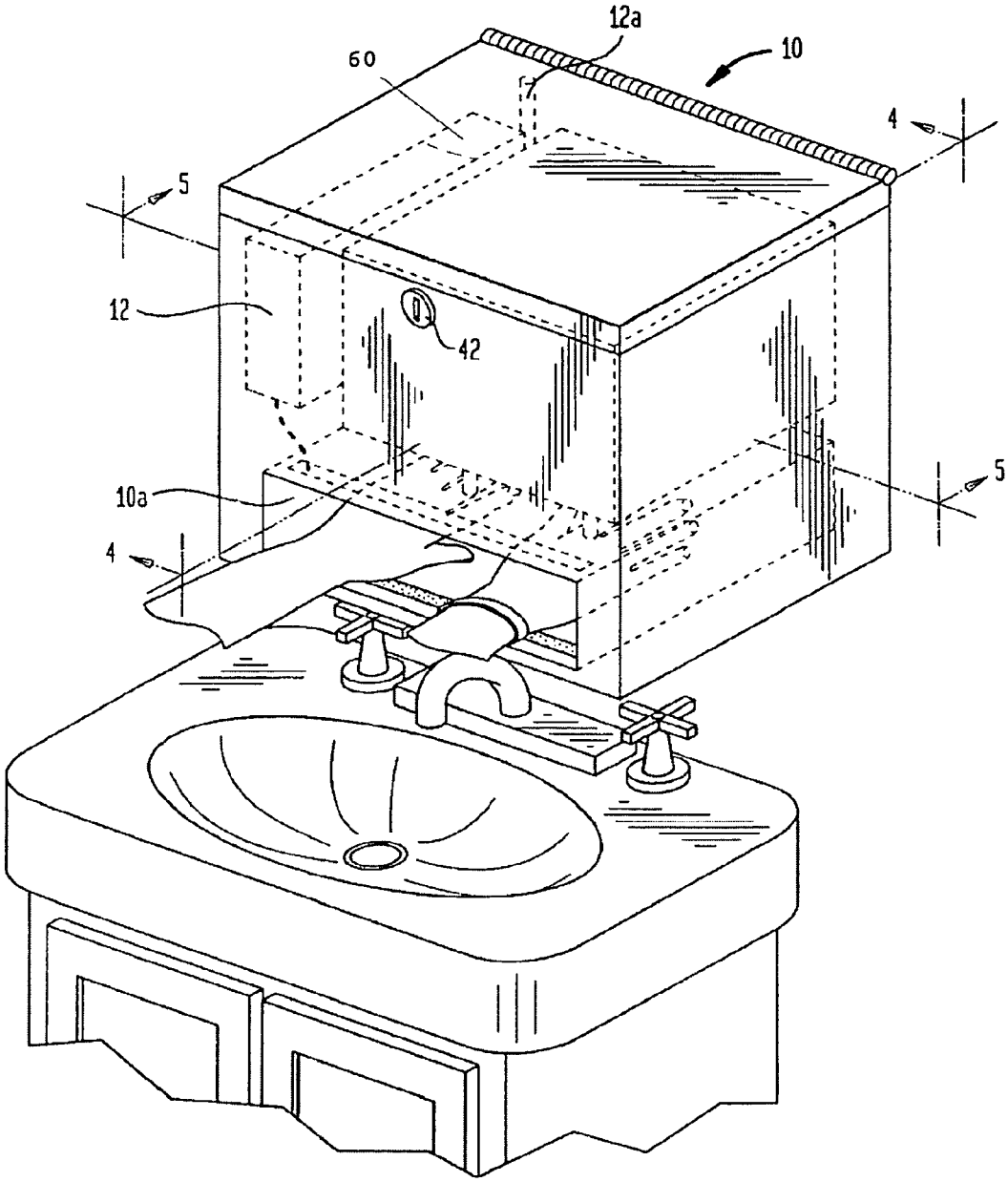
FIG. 1 is a perspective view of the preferred embodiment of the portable hand wash monitoring system in use in conjunction with a cleaning area comprising a faucet and sink, with the monitored individual's hands being shown inserted in the dispenser opening of the portable monitoring dispenser (PMD)

FIG. 1 is a perspective view illustrating a portable hand wash monitoring system embodying the present invention, in use by an individual. A portable monitoring dispenser (PMD) 10 is provided in the washroom in close proximity to a cleaning area, which in this illustrative case comprises a faucet and a sink. The PMD 10 has a dispenser opening 10*a*, into which an individual inserts his hands prior to washing them. As will be explained below, the insertion of the hands is sensed by the PMD 10, which dispenses soap. The station also provides an indication to the system that the hands have been inserted.

Figure 3:
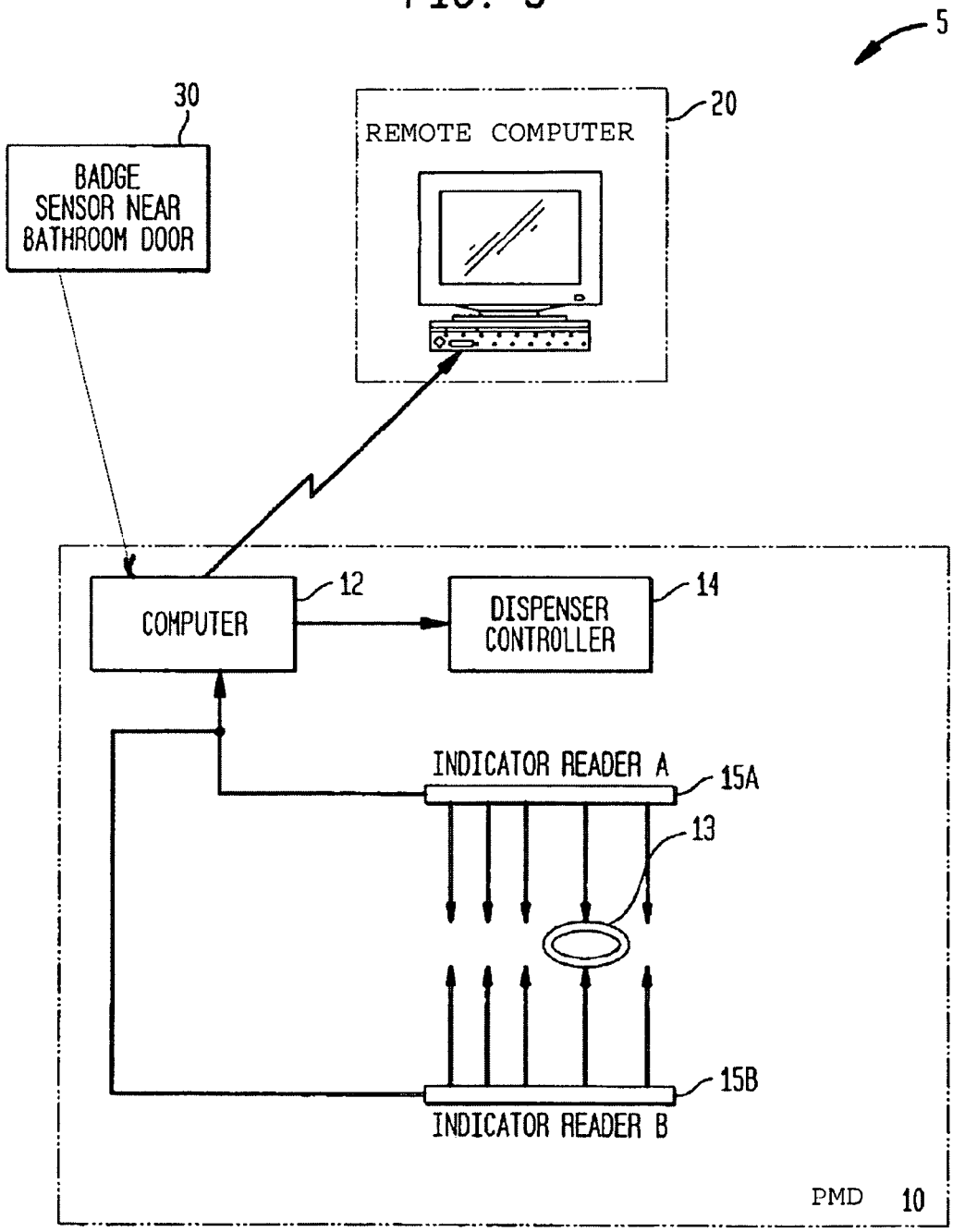
FIG. 3 is a functional block diagram illustrating the cooperation of the various components of the preferred embodiment of the portable hand wash monitoring system.

FIG. 3 is functional block diagram illustrating the major components of the hand wash system and their cooperation. The three major components are a remote data retrieval means, which in this illustrative example is a remote computer 20; an identity sensor 30 provided near a door or access to a lavatory area, where an individual would enter and leave the lavatory area; and the PMD 10 described previously. The identity sensor 30 senses an identification device, typically a badge, worn by an individual when he enters the lavatory area, and communicates, preferably wirelessly, with a system control device 12, which in the preferred embodiment is a CPU controller located within the PMD.

In the preferred embodiment, the system control device 12 communicates wirelessly with the remote data retrieval means 20, which is a remote computer in this example. Where a wireless link is not feasible, the system control device 12 can communicate with the remote computer 20 by means of a USB upload. The monitored individual wears an indicator device 13 on or about his hands. In the preferred embodiment, this is a wristband. A pair of indicator readers 15A, 15B are located inside the PMD 10, and positioned so that the indicator device 13 must be located between them in order to be sensed by both. Upon sensing the indicator device 13, the indicator readers 15A, 15B transmit an indication signal to the system control device 12 indicating that the monitored individual has washed his/her hands. Upon receiving the indication signal, the system control device 12 sends an activation signal to a dispenser controller 14, which dispenser controller 14 responds to the activation signal by activating a soap dispenser to deposit a hand wash solution 46*a* on the hands of the monitored individual.

Figure 6:
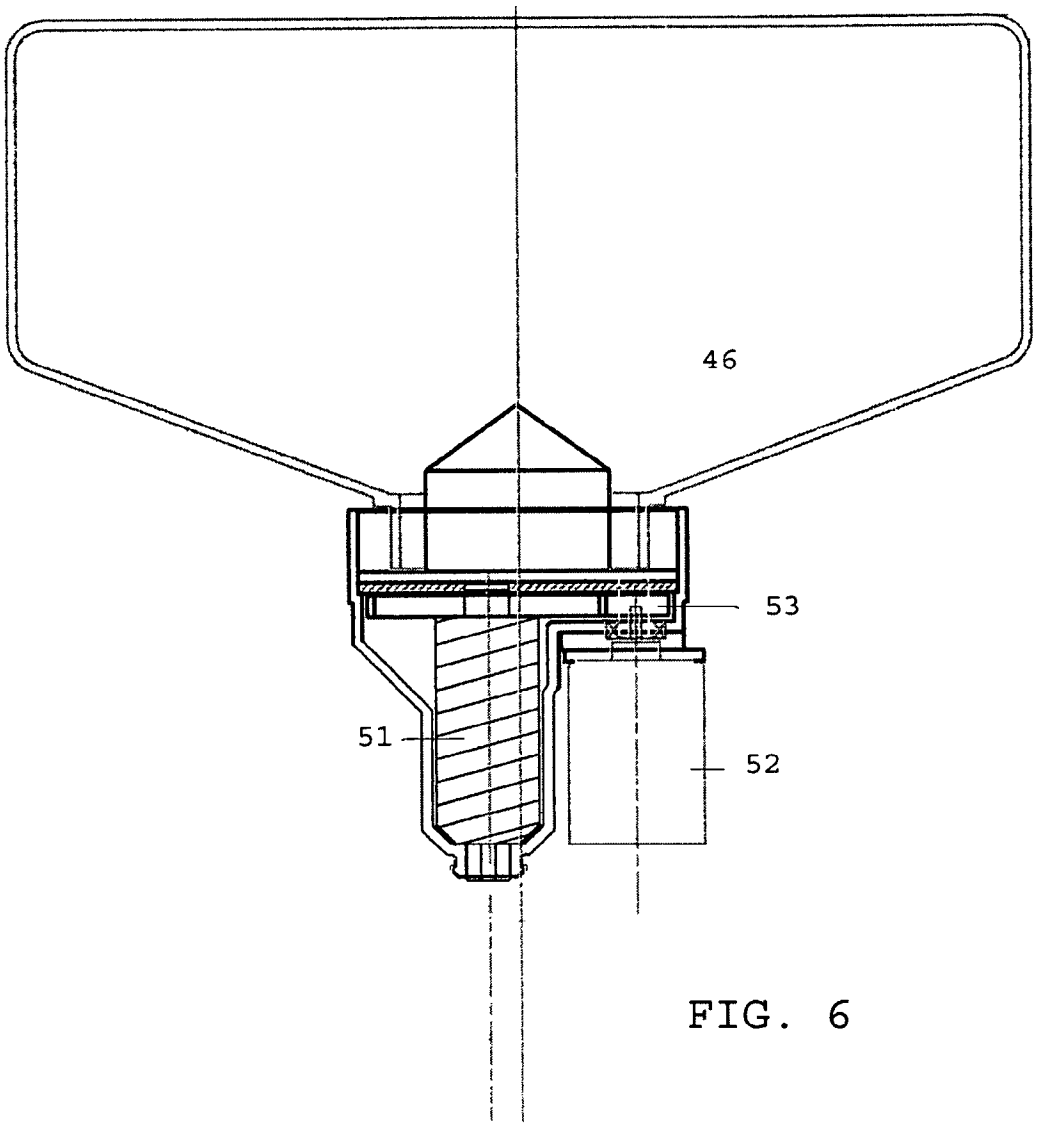
FIG. 6 is a cross-sectional detail view of one of the dispenser controllers.

As illustrated in FIG. 6, in the preferred embodiment, the dispenser controller 14 comprises a helical screw conveyor 51 and a motor 52. The activation signal causes the motor 52 to be activated for a designated time interval. The motor has a shaft which rotates when the motor 52 is activated. The shaft is coupled to the helical screw conveyor 51 by a gearing means 53, consisting to two gears, which can be spur, helical, worm, or bevel gears. Thus, when the motor 52 is activated by the activation signal, the helical screw conveyor 51 rotates for the designated time interval, thereby drawing a set quantity of hand wash solution 46*a* out of a storage tank 46 that is fluidly connected to the dispenser controller 14. The set quantity of hand wash solution 46*a* dispensed is determined by the system control device 12 based on the rotational speed of the motor, the gear ratio, the designated time interval, and the depth and pitch of the thread of the helical screw conveyor 51.

Figure 2:
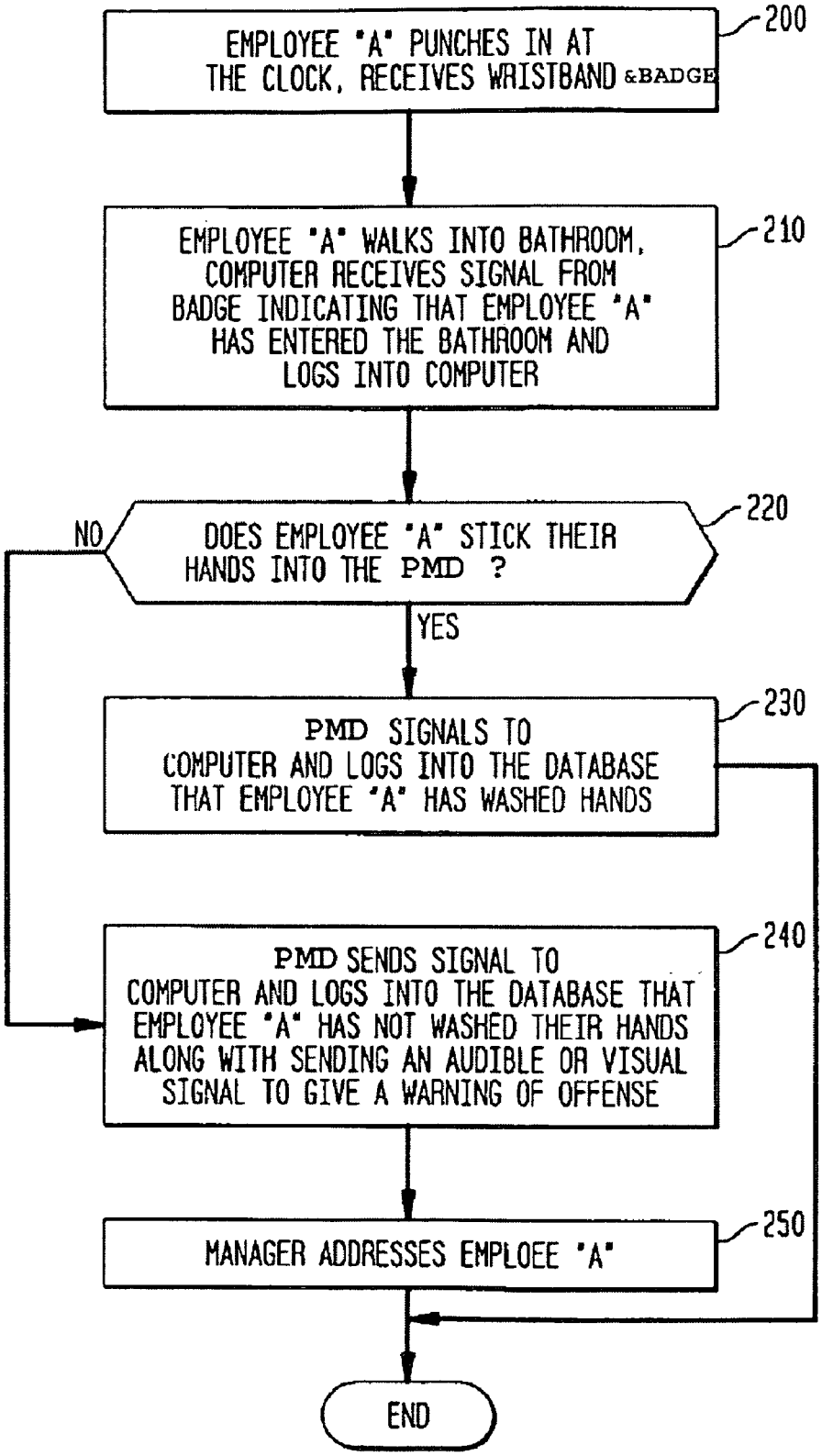
FIG. 2 is flowchart illustrating the operation of the preferred embodiment of the portable hand wash monitoring system.

FIG. 2 is a flowchart illustrating the operation of the preferred embodiment of the present invention. In this example, it is assumed that the individual is an employee at a remote location, such as an outdoor food stand. At step 200, the employee receives an indicator device 13 in form of a wristband when he/she arrives at the place of employment or punches into a clock. It will be appreciated that the indicator device 13 could also be in the form of a ring or band worn on a finger or any other type of a device worn on or about the hands. It will also be appreciated that the indicator device could be provided to the individual at the time that he/she enters the lavatory area or the cleaning area. In any case, it is assumed that the employer requires every employee to wear an identification device, typically a badge. Many such types of badges are available today, including ones that can be sensed by a remote sensor as an individual wearing the badge passes. Such an identity sensor 30 is provided in the vicinity of the access to the lavatory area and senses the identity of an individual passing through the door. This information and the identity of the individual are transmitted to the system control device 12 (Step 210).

Upon departing from the lavatory area, the employee would be expected to proceed to the cleaning area and place his/her hands into the PMD 10. This would cause the indicator readers 15A, 15B to sense the indicator device 13 and send an appropriate message to the CPU controller 12. At the same time, soap would be deposited upon the individual's hands, and he/she would need to wash his/her hands in order to remove it.

At step 220, a test is performed to determine whether an indication signal was received from indicators 15A, 15B. This could occur after the identity sensor 30 senses that the individual has left the lavatory area. If so, the CPU controller 12 signals to the remote computer 20 that it has received an indication signal and an entry could be made in a database within computer 20 indicating that the individual has washed his/her hands (Step 230).

Should the CPU controller 12 not have received the indication tested for in Step 220 after the individual has left the lavatory area, the CPU controller 12 signals to the remote computer 20 that the employee failed to wash his hands and an appropriate entry is made in the database (Step 240). An appropriate visual or audible alarm could also be provided to draw the attention of a manager and to indicate the identity of the individual who failed to wash his hands. The manager could then have an appropriate discussion with that individual and assure that he returns to wash his hands (Step 250).

Figure 4:
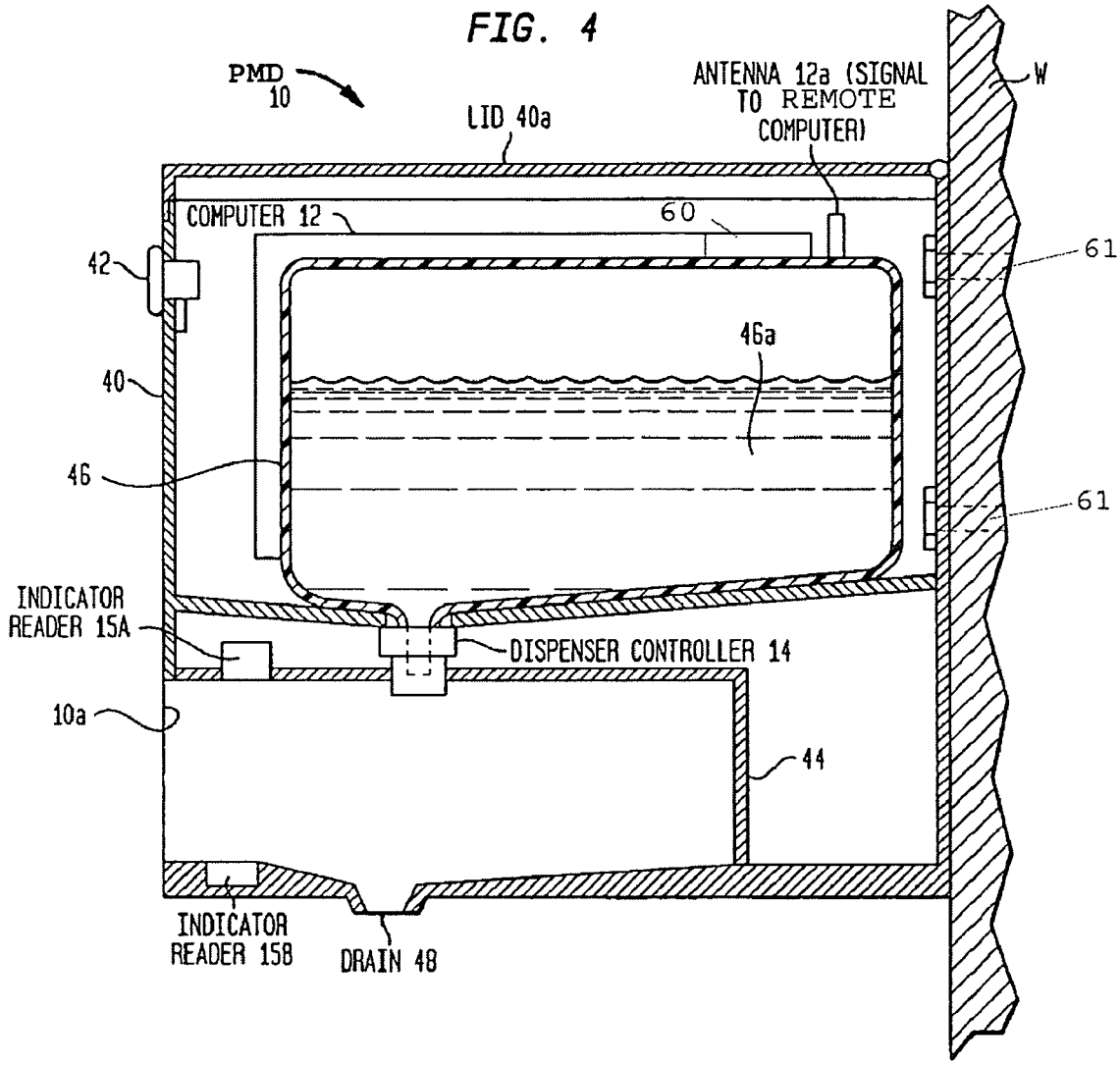
FIG. 4 is an enlarged, sectional view taken along contour 4-4 in FIG. 1 and looking in the direction of the arrows to illustrate internal details of the PMD.
Figure 5:
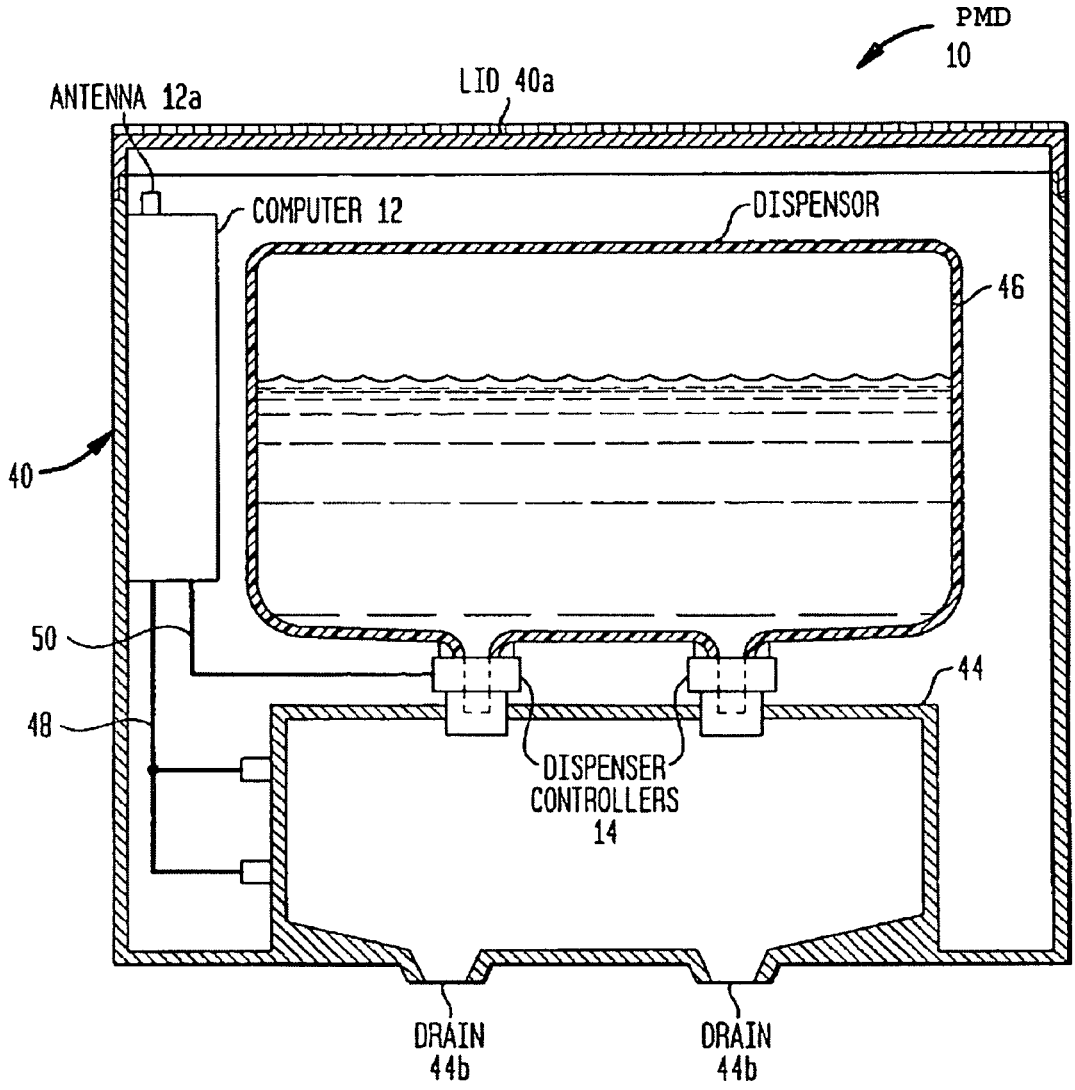
FIG. 5 is a sectional view taken along line 5-5 in FIG. 1 and looking in the direction of the arrows to illustrate further internal details of the PMD.

FIGS. 4 and 5 are sectional views illustrating the preferred inner construction of the PMD 10. As may be seen, PMD 10 is provided inside an enclosure 40, which includes a hinged lid 40*a*, through which the interior of the enclosure may be accessed. The lid is prevented from being opened by means of a lock 42. The CPU controller 12 is mounted on the interior of the enclosure 40 and preferably has a wireless transmitter with an antenna 12*a*. Also mounted within or upon the enclosure 40 is a mobile power source 60, which preferably comprises either a high-capacity rechargeable battery or a solar panel. Within enclosure 40, there is provided an enclosed compartment 44 which is accessed via the dispenser opening 10*a*. Above the compartment 44, there is provided a storage tank 46 containing soap solution 46*a*. The storage tank 46 communicates with compartment 44 through the dispenser controllers 14, which enter compartment 44 from above.

Two indicator readers 15A and 15B are provided near the front of compartment 44 in upper and lower walls, respectively. In the bottom wall of compartment 44, there are provided drains 44*b*, 44*b*, which permits excess soap solution to be disposed through the sink which lies below. The CPU controller 12 is coupled to via leads 48 to the two indicator readers 15A and 15B, and it is coupled via leads 50 to the dispenser controllers 14. As may be seen in FIG. 4, the enclosure 40 is mounted, by one or more attachment means 61, to a convenient available structure, such as a wall W, within the cleaning area.

Although a preferred embodiment of the invention has been disclosed for illustrative purposes, those skilled in the art will appreciate that many additions, modifications and substitutions are possible, without departing from the scope and spirit of the present invention as defined by the accompanying claims.

I claim:

1. A system for monitoring cleaning of the hands of one or more monitored individuals, comprising:

a lavatory area, wholly or partially enclosed, accessed by one or more doors and/or openings;

one or more identity sensors located within or in close proximity to the lavatory area, each identity sensor being proximate to one of the doors and/or openings;

one or more cleaning areas located within or in close proximity to the lavatory area; each cleaning area comprising one or more sources of fresh running water and one or more wastewater receptacles;

one or more portable monitoring dispensers (PMDs) located within each of the cleaning areas, each of the PMDs being in close proximity to one of the sources of running water and one of the wastewater receptacles; each PMD comprising one or more pairs or indicator readers, one or more dispenser openings, a system control device, one or more soap dispensers, one or more dispenser controllers, one or more soap storage tanks, a mobile power source, and one or more attachment means;

one or more pairs of indicator readers located within each of the PMDs, proximate to the soap dispenser, such that the space between the indicator readers constitutes a dispenser opening through which the hands of the monitored individual are inserted in order to access the soap dispenser;

an identification device that is worn by each monitored individual, such that when the monitored individual enters or leaves the lavatory area through one of the doors and/or openings, the identity sensor that is proximate to the door and/or opening senses the identification device and transmits the identity of the monitored individual who has passed through the door to a system control device;

one or more indicator devices that is/are worn on or about one or both hands of each monitored individual, such that when the hands of the monitored individual are placed in the dispenser opening, the indicator readers sense the presence of the indicator device(s) and transmit two signals: (i) an indication signal to the system control device indicating that the monitored individual has washed his/her hands, and (ii) an activation signal to a dispenser controller, which dispenser controller responds to the signal by activating the soap dispenser to deposit a hand wash solution on the hands of the monitored individual;

an alarm that generates a warning signal whenever the system control device has received transmissions from the identity sensor(s) indicating that the monitored individual has entered and exited from the enclosed area without the system control device also having received an indication signal from the indicator reader(s) that the monitored individual has washed his/her hands; and wherein the dispenser controller comprises a motor and a helical screw conveyor, and wherein the activation signal causes the motor to be activated for a designated time interval, and wherein the motor has a shaft which rotates when the motor is activated, and wherein the shaft is coupled to the helical screw conveyor by a gearing means, such that when the motor is activated by the activation signal, the helical screw conveyor rotates for the designated time interval, thereby drawing a set quantity of hand wash solution out of a storage tank that is fluidly connected to the dispenser controller, and such that the set quantity of hand wash solution dispensed is determined by the system control device based on the rotational speed of the motor, the gear ratio, the designated time interval, and the depth and pitch of the thread of the helical screw conveyor.

2. A system for monitoring cleaning of the hands of one or more monitored individuals, comprising:

a lavatory area, wholly or partially enclosed, accessed by one or more doors and/or openings;

one or more identity sensors located within or in close proximity to the lavatory area, each identity sensor being proximate to one of the doors and/or openings;

one or more cleaning areas located within or in close proximity to the lavatory area; each cleaning area comprising one or more sources of fresh running water and one or more wastewater receptacles;

one or more portable monitoring dispensers (PMDs) located within each of the cleaning areas, each of the PMDs being in close proximity to one of the sources of running water and one of the wastewater receptacles; each PMD comprising one or more pairs or indicator readers, one or more dispenser openings, a system control device, one or more soap dispensers, one or more dispenser controllers, one or more soap storage tanks, a mobile power source, and one or more attachment means;

one or more pairs of indicator readers located within each of the PMDs, proximate to the soap dispenser, such that the space between the indicator readers constitutes a dispenser opening through which the hands of the monitored individual are inserted in order to access the soap dispenser;

an identification-indicator device that is worn by each monitored individual, such that when the monitored individual enters or leaves the lavatory area through one of the doors and/or openings, the identity sensor that is proximate to the door and/or opening senses the identification-indicator device and transmits the identity of the monitored individual who has passed through the door to a system control device; and such that when the hands of the monitored individual are placed in the dispenser opening, the indicator readers sense the presence of the identification-indicator device and transmit two signals: (i) an indication signal to the system control device indicating that the monitored individual has washed his/her hands, and (ii) an activation signal to a dispenser controller, which dispenser controller responds to the signal by activating the soap dispenser to deposit a hand wash solution on the hands of the monitored individual;

an alarm that generates a warning signal whenever the system control device has received transmissions from the identity sensor(s) indicating that the monitored individual has entered and exited from the enclosed area without the system control device also having received an indication signal from the indicator reader(s) that the monitored individual has washed his/her hands; and wherein the dispenser controller comprises a motor and a helical screw conveyor, and wherein the activation signal causes the motor to be activated for a designated time interval, and wherein the motor has a shaft which rotates when the motor is activated, and wherein the shaft is coupled to the helical screw conveyor by a gearing means, such that when the motor is activated by the activation signal, the helical screw conveyor rotates for the designated time interval, thereby drawing a set quantity of hand wash solution out of a storage tank that is fluidly connected to the dispenser controller, and such that the set quantity of hand wash solution dispensed is determined by the system control device based on the rotational speed of the motor, the gear ratio, the designated time interval, and the depth and pitch of the thread of the helical screw conveyor.

3. A method for monitoring cleaning of the hands of one or monitored individuals, comprising:

sensing the identity of the monitored individual as he/she enters and exits a lavatory area;

transmitting to a system control device an identification signal identifying the monitored individual who has entered and exited the lavatory area;

detecting the presence of an indicator device worn on or about the hands of the monitored individual when he/she is in a cleaning area and his/her hands are positioned in a portable monitoring dispenser (PMD) between two paired indicator readers; there being is a space between the indicator readers that constitutes a dispenser opening through which the hands of the monitored individual are inserted in order to access a soap dispenser in the PMD;

transmitting an indicator signal to a system control device when the indicator device is detected within the dispenser opening by the two paired indicator readers;

transmitting an activation signal to a dispenser controller, which dispenser controller responds to the signal by activating the soap dispenser to deposit a hand wash solution on the hands of the monitored individual;

generating a warning whenever the system control device has received an identification signal without having received a hand washing signal; and wherein the dispenser controller comprises a motor and a helical screw conveyor, and wherein the activation signal causes the motor to be activated for a designated time interval, and wherein the motor has a shaft which rotates when the motor is activated, and wherein the shaft is coupled to the helical screw conveyor by a gearing means, such that when the motor is activated by the activation signal, the helical screw conveyor rotates for the designated time interval, thereby drawing a set quantity of hand wash solution out of a storage tank that is fluidly connected to the dispenser controller, and such that the set quantity of hand wash solution dispensed is determined by the system control device based on the rotational speed of the motor, the gear ratio, the designated time interval, and the depth and pitch of the thread of the helical screw conveyor.

* * * * *